United States Patent [19]

Bauman et al.

[11] 4,332,666

[45] Jun. 1, 1982

[54] COAL LIQUEFACTION PROCESS WHEREIN JET FUEL, DIESEL FUEL AND/OR ASTM NO. 2 FUEL OIL IS RECOVERED

[75] Inventors: Richard F. Bauman, Houston; Daniel F. Ryan, Friendswood, both of Tex.

[73] Assignee: Exxon Research & Engineering Co., Florham Park, N.J.

[21] Appl. No.: 147,428

[22] Filed: May 6, 1980

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 4,045,328 | 8/1977 | Green et al. | 208/8 LE |
| 4,146,459 | 3/1979 | Burke | 208/8 LE |

FOREIGN PATENT DOCUMENTS

| | | | |
|---|---|---|---|
| 2737337 | 2/1978 | Fed. Rep. of Germany | 208/8 LE |
| 2823811 | 12/1978 | Fed. Rep. of Germany | 208/8 LE |

*Primary Examiner*—Delbert E. Gantz
*Assistant Examiner*—William G. Wright
*Attorney, Agent, or Firm*—Wayne Hoover

[57] ABSTRACT

An improved process for the liquefaction of coal and similar solid carbonaceous materials wherein a hydrogen donor solvent or diluent derived from the solid carbonaceous material is used to form a slurry of the solid carbonaceous material and wherein the naphthenic components from the solvent or diluent fraction are separated and used as jet fuel components. The extraction increases the relative concentration of hydroaromatic (hydrogen donor) components and as a result reduces the gas yield during liquefaction and decreases hydrogen consumption during said liquefaction. The hydrogenation severity can be controlled to increase the yield of naphthenic components and hence the yield of jet fuel and in a preferred embodiment jet fuel yield is maximized while at the same time maintaining solvent balance.

4 Claims, 1 Drawing Figure

COAL LIQUEFACTION PROCESS WHEREIN JET FUEL, DIESEL FUEL AND/OR ASTM NO. 2 FUEL OIL IS RECOVERED

The Government of the United States of America has rights in this invention pursuant to Cooperative Agreement No. DE-FC01-77ET10069 (formerly EF-77-A-01-2893) awarded by the U.S. Energy Research and Development Administration, now the U.S. Department of Energy.

BACKGROUND OF THE INVENTION

This invention relates to an improved process for converting coal or similar solid carbonaceous materials. More particularly, this invention relates to an improved process for liquefying coal and similar carbonaceous substances.

As is well known, coal may be converted to liquid and gaseous fuels which may, in part at least, be substituted for naturally occurring liquid and gaseous fuels. Moreover, these liquid and gaseous products may be used directly or converted to produce chemical feedstocks.

Of these several coal conversion processes proposed heretofore, the liquefaction processes yield a broader range of product distribution and, therefore, likely candidates for the production of alternates for petroleum derived fuels and chemical raw materials.

Of these several liquefaction processes heretofore proposed, those processes wherein coal is liquefied in the presence of a solvent or diluent, particularly a hydrogen donor solvent or diluent, and a hydrogen containing gas appear to offer the greater advantages. In these processes, liquefaction is accomplished at elevated temperatures and pressures and as previously indicated a broad range of gaseous and liquid products are obtained. For the most part, however, these processes result in high relative yields of higher boiling point liquids; i.e., products boiling in the fuel oil and vacuum gas oil ranges and relatively high yields of gaseous products. The bulk of the products obtained from these processes, then, are at best substitutes for coal and applications where coal could be used directly. Moreover, these liquids are highly aromatic containing, typically, in excess of 80% aromatics making the liquids unsuitable for use directly as jet fuel, diesel fuel or as an ASTM No. 2 fuel oil. The need, therefore, for a liquefaction process wherein liquid products useful as jet fuels, diesel fuels and/or as an ASTM No. 2 fuel oil are produced directly is believed to be readily apparent.

SUMMARY OF THE INVENTION

It has now been discovered that the foregoing and other disadvantages of the prior art processes can be reduced with the method of the present invention and an improved liquefaction processes provided thereby. It is, therefore, an object of this invention to provide an improved liquefaction process. It is another object of this invention to provide such an improved liquefaction process wherein jet fuel, diesel fuel and/or ASTM No. 2 fuel oil may be produced directly. It is still a further object of this invention to provide such as improved liquefaction process wherein lower yields of gaseous products and an associated reduction in hydrogen consumption is realized. The foregoing and other objects and advantages will become apparent from the description set forth hereinafter and from the drawings appended thereto.

In accordance with the present invention, the foregoing and other objects and advantages are accomplished by liquefying a coal or similar solid carbonaceous material in the presence of a hydrogen donor solvent at elevated temperatures and pressures. The hydrogen donor solvent may be derived from the coal or similar solid carbonaceous material subjected to liquefaction and will be hydrogenated prior to recycle to provide at least a portion of the donatable hydrogen. The conditions of hydrogenation will be controlled such that at least a portion of the aromatic content of the solvent fraction is converted to naphthenic materials which will be separated prior to recycle and used in either a jet fuel composition, a direct fuel composition or an ASTM No. 2 fuel oil.

BRIEF DESCRIPTION OF THE DRAWINGS

The FIGURE is a schematic flow diagram of a process within the scope of the present invention.

DETAILED DESCRIPTION OF THE INVENTION

Figure 1:
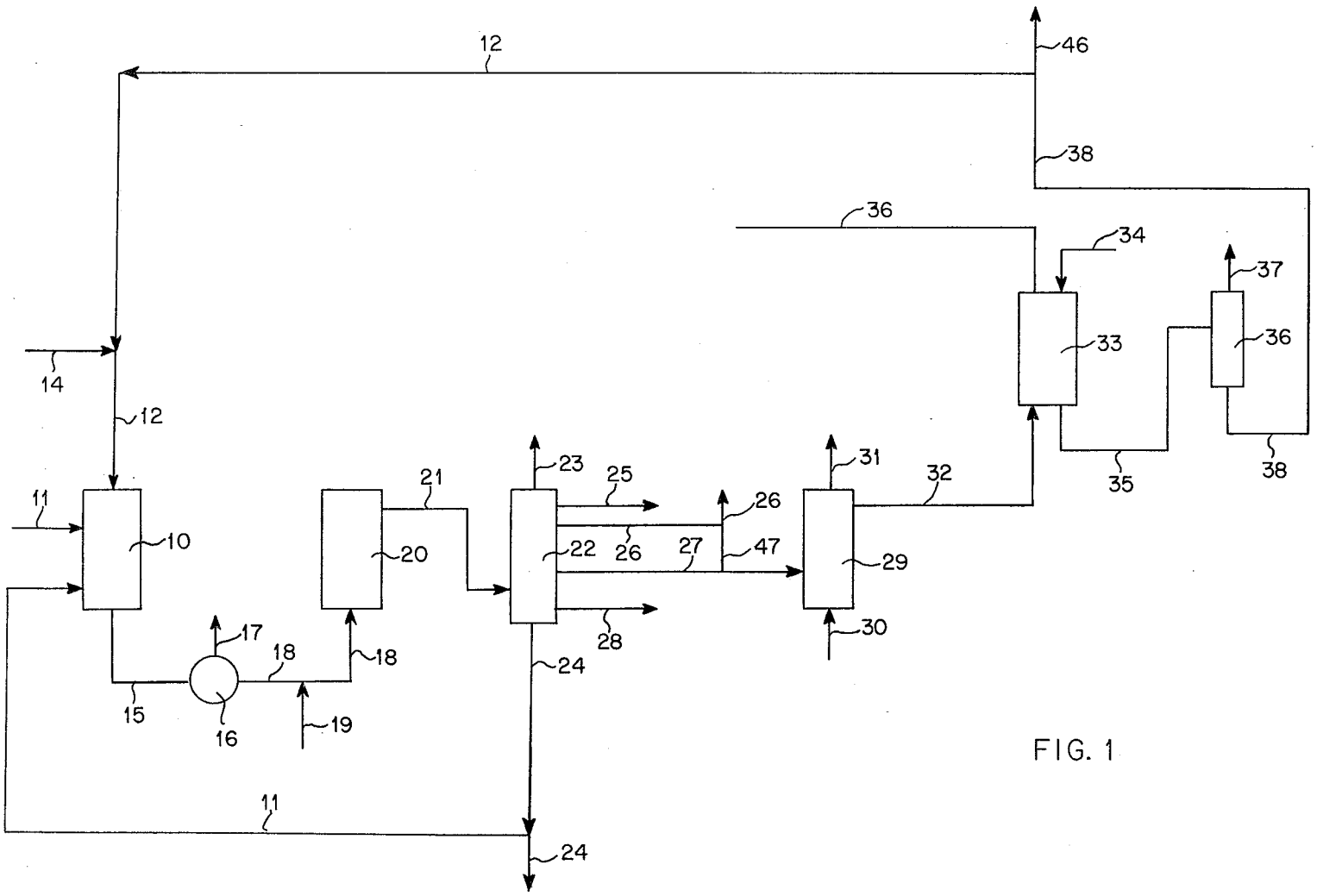

As indicated supra, the present invention relates to an improved process for liquefying coal and similar solid carbonaceous materials wherein liquefaction is accomplished at an elevated temperature and pressure. As also indicated supra, the liquefaction is accomplished in the presence of a hydrogen donor solvent which may be derived from the coal or similar solid carbonaceous material subjected to liquefaction. The yield of jet fuel, diesel fuel and/or ASTM No. 2 fuel oil components are controlled by controlling the conditions at which the solvent is hydrogenated and the jet fuel, diesel fuel and/or ASTM No. 2 fuel oil components are separated from the donor solvent prior to recycling the solvent to the liquefaction reactor.

In general, the method of the present invention can be used to liquefy any solid carbonaceous material which can, effectively, by hydrogenated and thus liquefied. The method of the invention is particularly useful in the liquefaction of coal and may be used to liquefy any of the coals known in the prior art including anthracite, bituminous coal, subbituminous coal, lignite, peat, brown coal and the like. The process may also be used to liquefy coke and carbon-containing residues such as coal liquefaction and gasification residues.

In general, the solid carbonaceous material will be ground to a finely divided state. The particular particle size or particle size range, actually employed, however, is not critical to the invention and, indeed, essentially any particle size can be used. Notwithstanding this, generally, the solid carbonaceous material which is liquefied in accordance with this invention will be ground to a particle size of less than about ¼" and preferably to a particle size of less than about 8 mesh (NBS sieve size). After the solid carbonaceous material has been sized, the same will then be slurried with a hydrogen donor solvent or diluent. Normally, the ratio of solvent or diluent to coal (on a moisture-free basis) in the slurry will be within the range from about 0.8:1 to about 10:1 on a weight basis. Ratios in the higher portion of this range will, of course, be required at higher bottoms recycle rates to ensure that the slurry when bottoms are incorporated, can be transported by pumping or the like.

In general, any of the solvents or diluents known in the prior art to contain at least about 0.8 wt % of donatable hydrogen based on the weight of total solvent can be used in the improved process of this invention. Suitable solvents include pure compounds as well as mixtures of such compounds in combinations with components which will not donate hydrogen at liquefaction conditions. Compounds which will donate hydrogen during liquefaction are believed well known in the prior art and many are described in U.S. Pat. No. 3,867,275. These include the indanes, the dihydronaphthalenes, the $C_{10}$–$C_{12}$ tetra-hydronaphthalenes, the hexahydrofluorenes, the dihydro-, tetrahydro-, hexahydro- and octahydro- phenanthrenes, the $C_{12}$–$C_{13}$ acenaphthenes, the tetrahydrohexahydro- and decahydropyrenes, the di-, tetra- and octahydroanthracenes, and other derivatives of partially saturated aromatic compounds. Particularly effective mixed solvents include hydrogenated creosote oil and distillate fractions derived from the liquefaction of coal or similar solid carbonaceous materials. Particularly effective distillate fractions include those having an initial boiling point within the range from about 350° to about 450° F. and a final boiling point within the range from about 650° to about 950° F. These mixed solvents will, generally, be hydrogenated to contain at least 25 wt % of hydrogen donor species.

After the solid carbonaceous material has been slurried, the slurry will then be subjected to liquefaction at a temperature within the range from about 700° to about 1000° F. and at a pressure within the range from about 1000 to about 3000 psig. In a preferred embodiment, the liquefaction will be accomplished in the presence of from about 2 to about 10 wt % molecular hydrogen based on dry solid carbonaceous material. In addition, and where increased yields of lighter boiling range liquid materials are desired, the liquefaction will be accomplished in the presence of recycle bottoms at higher pressures within the aforementioned range. In those cases where a maximum yield of heavier boiling range materials is desired, the liquefaction will be accomplished without bottoms recycle and at lower pressures. In any case and, in general, the total nominal holding time during liquefaction will range from about 10 to about 200 minutes and the liquefaction may be accomplished in a single liquefaction zone or in a plurality of such zones.

In general, the liquefaction will result in the production of a gaseous product, a liquids product and a normally solid bottoms product. After liquefaction these products will be separated into their respective phases using conventional techniques. For example, the gaseous product may be simply flashed overhead and the liquids and solid then separated using filtration, centrifugation or distillation. Of these, distillation is preferred since it affords the cleanest and most controllable means of separating liquids and solids. After separation, the gaseous product may be upgraded to a pipeline gas or the same may be burned to provide energy for the liquefaction process. Alternatively, all or a portion of the gaseous product may be reformed to provide hydrogen for the liquefaction process.

The liquid product may be fractionated into essentially any desired product distribution and/or a portion thereof may be used directly as a fuel or upgraded using conventional techniques. In a preferred embodiment, however, a portion of the liquid will be separated and used as a solvent or diluent in a liquefaction process of this invention. In accordance with the improved method of this invention, the solvent or diluent fraction will be hydrogenated to increase the amount of donatable hydrogen therein prior to recycling or used as the solvent or diluent. Also in accordance with the present invention, the hydrogenation will be controlled such that at least a portion of the solvent or distillate fraction is completely hydrogenated to produce jet fuel, diesel fuel and/or ASTM No. 2 fuel oil components. These components will then be separated prior to recycling of the solvent or diluent fraction. Moreover, and when desired, completely saturated species from other distillate fraction of the liquefaction product may be separated and combined with the jet fuel, diesel fuel and/or ASTM No. 2 fuel oil components.

Finally, the bottoms may be burned directly to produce energy for the liquefaction process or gasified to produce either an intermediate BTU fuel gas or hydrogen for use in the liquefaction process. In accordance with one embodiment of the present invention, however, and when increased yields of lighter boiling range liquid products is desired at least a portion of the bottoms will be withdrawn and recycled directly to the liquefaction zone. Such recycle may be accomplished simply by combining the recycled bottoms with the coal during the slurry preparation. In general, the amount of bottoms actually recycled will range from about 0 to about 5 parts of bottoms per part of coal fed to the liquefaction zone. The effect of recycling bottoms on relative liquid yields is discussed in copending application Ser. No. 106,068 filed on Dec. 20, 1979, now abandoned and the disclosure of this copending application is hereby incorporated herein.

As is well known, the liquids obtained via liquefaction of coal are an extremely complex mixture of saturated and unsaturated compounds including aromatic, hydroaromatic, naphthoaromatic and heteroaromatic compounds. It has been estimated that the number of individual carbon homologs in the liquefaction product is at least 2 or 3 thousand and that the number of individual components is at least a magnitude larger. In general, the liquid product will have an initial boiling point within the range from about 100° to about 200° F. and a final boiling point within the range from 950° to about 1150° F., depending primarily upon the method used to effect the separation between the liquid and solid phases of the reaction product. In general, the saturates contained in the liquefaction product will have generic formula ranging from $C_nH_{2n+2}$ to $C_nH_{2n-14}$. The aromatic hydrocarbon components will generally contain from 1 to 7 rings.

While the coal liquid product is extremely complex, it is well known that the same contains several components which are known to be capable of donating hydrogen at liquefaction conditions. In general, the components capable of donating hydrogen are hydroaromatic compounds containing benzilic carbons or hydrogens. In the conventional solvent or diluent boiling range, the hydrogen donor components will contain 2, 3 and 4 rings wherein at least one terminal ring is at least partially saturated. A common hydrogen donor in this group is, then, tetralin which may be represented structurally as follows:

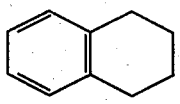

Two of the more common three-ring hydrogen donor species are tetra- and octahydrophenanthrene. These components may be represented structurally and respectively by the following formulae:

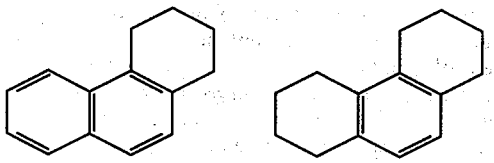

Illustrative of the four-ring hydrogen donor species are tetrahydropyrene and tetrahydrochrysene. These compounds are represented structurally and respectively by the following formulae:

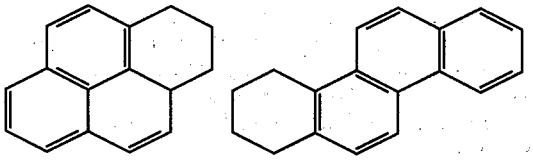

As will be apparent from the foregoing formulae, the known hydrogen donors contain at least one aromatic ring and one ring which is at least partially saturated. When hydrogen is liberated, the saturated ring or rings are converted to a corresponding but less saturated ring. When a 6-member ring is involved, the hydrogen donor component may be converted to the corresponding aromatic component. It will, of course, be appreciated that while the hydrogen donor species have been illustrated with 6-member rings, combined 5- and 6-member ring compounds are known and are effective hydrogen-donor species. Moreover, substituted homologs of these compounds and particularly those containing hydrocarbonaceous side chains are contained, generally, in a coal liquefaction product and many are known to be effective hydrogen donors during liquefaction.

As is also well known, coal liquefaction products contain completely aromatic constituents and completely saturated constituents corresponding, generally, in structure to the "hydrogen donor" components illustrated above. Moreover, and is well known in the prior art, the corresponding aromatic components may be converted to hydrogen donor species by partial hydrogenation and both the aromatic constituents and hydrogen donor species may be converted to the corresponding completely saturated species. The completely saturated species and particularly those boiling within the range from about 350° to about 550° F. are useful jet fuel components. Completely saturated species boiling within the range from about 350° and about 600° F. are useful diesel fuel components and those boiling from about 350° F. to about 650°–700° F. are useful as ASTM No. 2 fuel oil components. Coal liquefactions distillate fractions containing aromatic and hydroaromatics which are convertible to completely saturated constituents boiling within the jet fuel, diesel fuel and/or ASTM No. 2 fuel oil component range can, then, be used directly as jet fuel, diesel fuel ASTM No. 2 fuel oil or as components in these fuels in accordance with the method of the present invention.

Heretofore, it has been known to hydrogenate selected liquefaction distillate fractions to increase the concentration of donatable hydrogen species contained therein. Moreover, and as indicated in copending application Ser. No. 105,798 filed on Dec. 20, 1979, now U.S. Pat. No. 4,311,578, such solvent or diluent distillate fractions will contain from about 30 to about 75 wt % aromatics, from about 15 to about 30 wt % hydroaromatics and from about 10 to about 40 wt % saturated (predominantly naphthenic) constituents. These streams, then, traditionally contain constituents which would be useful as jet fuel, diesel fuel and/or ASTM No. 2 fuel oil components. Further, and as indicated in the copending application, the concentration of saturates is not significantly changed during the rather mild hydrogenation generally employed to increase the concentration of the hydrogen donor, hydroaromatics species. It is, then, within the scope of the present invention to simply extract the saturated components from the conventional solvent or diluent distillate fraction. In a more preferred embodiment, however, more severe hydrogenation conditions will be employed to thereby increase the concentration of saturates in the hydrogenated stream. Moreover, it is within the scope of the present invention to separate saturated components from other liquefaction distillate fractions and to use the separated, saturated components as jet fuel, diesel fuel and/or ASTM No. 2 fuel oil or a constituent therein. For example, it is within the scope of the present invention to separate decalin from the heavy naphtha (350°–400° F. boiling range) fraction and to use this separated decalin as a jet fuel, diesel fuel and/or ASTM No. 2 fuel oil component. For purposes of clarification reference is again made to copending application Ser. No. 105,798 filed on Dec. 20, 1979, now U.S. Pat. No. 4,311,578 and to the discussion contained therein concerning the composition of various distillate fractions and the disclosure of this application is hereby incorporated herein.

Generally the hydrogenation of the selected solvent or distillate fraction will be accomplished at a temperature within the range from about 650° to about 950° F. and at a pressure within the range from about 650 to about 2000 psig. The hydrogen treat rate during the hydrogenation generally will be within the range from about 1000 to about 10,000 SCF/bbl.

In general, any of the known hydrogenation catalysts may be used to effect the hydrogenation of the solvent or distillate fraction in accordance with this invention. Particularly effective catalysts include those comprising one or more Group VIII non-noble, or iron group metals, in combination with one or more Group VI-B metals in the periodic table. Generally, such catalysts will be supported on alumina, silica alumina or a similar support. Particularly effective combinations comprise the oxide or sulfide form of the Group VIII metal in combination with the oxide or sulfide form of the Group VI metal. Particularly effective combinations include, then, the oxides and/or sulfides of cobalt-molybdenum, nickel-molybdenum, nickel-tungsten, nickel-molybdenum-tungsten, cobalt-nickel-molybdenum and the like. A particularly effective cobalt-molybdenum catalyst is one comprising from about 1 to about 10 wt % cobalt oxide, preferably from about 2 to about 5% cobalt oxide, and from 10 to about 30 wt % molybdenum oxide. A particularly effective nickel-molybdenum catalyst will comprise from about 10 to about 25 wt % nickel oxide, preferably from about 15 to about 20 wt % nickel oxide, and from about 2 to about 5 wt % molybdenum. Such catalysts will, of course, be prepared in accordance with known techniques and many are available commercially.

Following the hydrogenation of the solvent or distillate fraction and prior to recycling to the liquefaction reactor, the saturated components will be separated either from the entire solvent, diluent fraction or a particular distillate fraction therefrom. For example, a fraction having an initial boiling point of about 350° F. and a final boiling point of about 550° F. could be cut and the saturates separated therefrom when a jet fuel is desired. The final boiling point could be increased to about 600° F. when a diesel fuel is desired and to about 650° F. or 700° F. when an ASTM No. 2 fuel oil is desired. In either case, the saturates would be separated and either used directly or further processed to yield the desired fuel. Also, and in either of the three cases, the aromatic-hydroaromatic fraction or a portion thereof will, preferably, be used as the solvent or diluent.

In general, any of the methods known to be effective in the prior art may be used to effect the desired separation. Processes useful for the selective extraction of aromatic and hydroaromatic compounds from the naphthenic components are known in the prior art and are particularly useful in the separation required by the present invention. For example, the aromatic components may be extracted with solvents such as diethylene glycol, tetraethylene glycol, tetrahydrothiophene, 1,1-dioxane n-methylpyrrolidone, dimethyl sulfoxide and with aqueous solutions of these solvents. Similarly, the aromatic and hydroaromatic components may be separated from the naphthenic components via extraction with liquid ammonia, liquid $SO_2$ and similar solvents. Following the separation, the aromatic and hydroaromatic components or at least a portion thereof will be, preferably, recycled to the liquefaction zone as the solvent or diluent.

PREFERRED EMBODIMENT

In a preferred embodiment of the present invention, coal will be liquefied at a temperature within the range from about 800° to about 880° F. and at a pressure within the range from about 1500 psig to about 2500 psig. In the preferred embodiment, the coal will be slurried with a solvent or diluent cut from the coal liquefaction liquid product and the solvent or diluent will be hydrogenated such that the same contains at least 50 wt % hydrogen donor species. The solvent or diluent to coal ratio in the slurry will be within the range from about 1:1 to about 5:1. Also in a preferred embodiment, bottoms will be recycled in an amount sufficient to provide a coal:bottoms ratio in the slurry within the range from about 1:1 to about 2:1. The nominal holding time during liquefaction will be within the range from about 40 to about 140 minutes.

In the preferred embodiment of this invention, a solvent or diluent distillate fraction will be cut from the liquefaction product and at least a portion of this distillate fraction will be catalytically hydrogenated at a temperature within the range from about 650° to about 850° F.; at a pressure within the range from about 1250 to about 2000 psia and at a hydrogen treat rate within the range from about 2000 to about 5000 scf/bbl. During hydrogenation, the nominal holding time will be within the range from about 30 to about 120 minutes.

In the preferred embodiment, a catalyst comprising from about 15 to about 20 wt % nickel oxide and from about 2 to about 5 wt % molybdenum oxide supported on an alumina carrier will be used to effect the hydrogenation. Following the hydrogenation, the completely saturated (naphthenic) compounds will be extracted by passing the hydrogenated distillate fraction through a counter current extraction unit using tetrahydrothiophene one, one dioxide as the extraction solvent. In the preferred embodiment, the hydrogenated distillate fraction will be contacted with from about 2 to about 6 volumes of selective solvent per volume of hydrogenated solvent. Generally, the countercurrent extraction will be accomplished at a temperature within the range from about 50° to about 150° F. and at a pressure within the range from about 0 to about 45 psig. After the extraction, the aromatic and hydroaromatic components will be recycled as solvent and the naphthenic components will be used as jet fuel components.

In a most preferred embodiment of this invention, the solvent or distillate fraction will have a initial boiling point of about 350° F. and a final boiling point within the range from about 750° to about 850° so as to maximize the yield of saturated two-ring components. In those cases where sufficient solvent does not remain after the separation of the saturated materials the solvent components from other sources may be added to the aromatic and hydroaromatic constituents recycled as solvent.

It is believed that the invention will be even better understood by reference to the attached FIG. 1 which illustrates a particularly preferred embodiment. Referring then to FIG. 1, a finely divided coal or similar solid carbonaceous material is introduced into mixing vessel 10 through line 11 and slurried with a hydrogen donor solvent or diluent introduced through line 12. In a preferred embodiment, the solvent will be derived from the solid being subjected to liquefaction, will be hydrogenated to produce a solvent containing at least 50 wt % hydrogen donor species and will be recycled to the mixing vessel through line 12'. During start-up, however, or when a recycle solvent is not employed, any of the known useful hydrogen donor solvents or diluents may be introduced into line 12 through line 14.

In mixing vessel 10, the coal may also be mixed with recycled bottoms introduced through line 11'. In a preferred embodiment, the coal and recycled bottoms will be combined in a ratio within the range from about 1:1 to about 2:1. As indicated previously, however, recycling of bottoms is optional and may range from 0 to about 5 parts of recycled bottoms per part of coal. As also previously indicated, when maximum yield of higher boiling range liquid products is desired, bottoms recycle will not be employed. When increased yields of lighter boiling range materials is, however, desired bottoms recycle will be used.

The slurry is withdrawn from mixing vessel 10 through line 15 and passed through preheater 16. In the preheater 16, the slurry will, generally, be preheated to the temperature desired for liquefaction. When desired and particularly when the solid carbonaceous material has not been previously dried, steam will be flashed overhead through line 17.

In general, the slurry of solid carbonaceous material will be combined with molecular hydrogen. The molecular hydrogen may be added to the slurry either prior to or after preheating. In the embodiment illustrated, however, the preheated slurry is withdrawn from the preheater through line 18 and hydrogen is introduced through line 19. Hydrogen from any source may be used but in a preferred embodiment, the hydrogen will be produced either by the steam reforming of at least a portion of the product gas from the liquefaction or by gasification of at least a portion of the liquefaction bottoms. Such hydrogen production will be accomplished in accordance with conventional technology. In general, sufficient hydrogen will be introduced to provide from about 2 to about 10 wt % molecular hydrogen based on dry, solid carbonaceous material.

The combined slurry hydrogen mixture is then passed directly to liquefaction vessel 20 through line 18'. In the liquefaction vessel 20, the solid carbonaceous material is at least partially liquefied and, generally, at least partially gasified. Preferably, the liquefaction vessel will be sized so as to provide a nominal holding time within the range from about 40 to about 140 minutes and, while a single vessel has been illustrated, a plurality of vessels may be employed. Also the temperature within the liquefaction zone will, preferably, be within the range from about 800° to about 880° F. and the liquefaction will be accomplished at a pressure within the range from about 1200 to about 1800 psig.

In the embodiment illustrated, the combined product from liquefaction vessel 20 is withdrawn through line 21 and passed to separating means 22. In general, any suitable separating means may be employed but a combined atmospheric and vacuum distillation column is preferred. In the embodiment illustrated, then, and when a distillation column or combination thereof is employed a gaseous product will be withdrawn overhead through line 23 and unconverted solid carbonaceous material, mineral matter and converted materials boiling at a temperature above about 950° to about 1050° F. are withdrawn through line 24. The material withdrawn through line 24 is referred to herein as liquefaction bottoms and all or a portion of these bottoms may be recycled to the slurry vessel 10 through line 11'. Alternatively, all or a portion of the bottoms may be withdrawn through line 24' and discarded burned, gasified to produce hydrogen or subjected to other treatment or upgrading via techniques well known in the prior art.

The liquid product is then fractionated into desired fractions and in the embodiment illustrated, a naphtha product boiling within the range from about 150° to about 350° F. is withdrawn through line 25, a heavy naphtha fraction boiling within the range from about 350° F. to about 400° F. is withdrawn through line 26, a solvent distillate fraction boiling within the range from about 400° F. to about 750° to about 850° F. is withdrawn through line 27 and a heavy liquid having an initial boiling point within the range from about 750° to about 850° F. and a final boiling point within the range from about 950° to about 1050° F. is withdrawn through line 28. In a most preferred embodiment, the heavy naphtha will be combined with the solvent fraction prior to hydrogenation thereof.

In general, the overhead gaseous material will comprise gaseous and lower boiling hydrocarbons, steam acid gases such as $SO_2$ and $H_2S$ and any ammonia which may have been produced during liquefaction. This stream may be scrubbed and further divided to yield a high BTU gas and lighter hydrocarbons. The naphtha stream may be subjected to further upgrading to yield a good quality gasoline and the heavier stream withdrawn through line 28 may be upgraded to produce a heavy fuel oil or cracked and reformed to yield a gasoline boiling fraction.

Generally, the solvent boiling range material or at least a portion thereof will be hydrogenated to increase the concentration of hydrogen donor species and in accordance with this invention, preferably, the entire solvent boiling range fraction will be hydrogenated firstly so as to increase the concentration of hydrogen donor species and secondly to increase the concentration of naphthenic components. The naphthenic components will, then, be selectively separated from the entire solvent fraction or a distillate fraction thereof and used as a jet fuel, diesel fuel, an ASTM No. 2 fuel oil or as blending components therefor. In the most preferred embodiment illustrated, the heavy naphtha withdrawn through line 26 is combined with the hydrogen distillate fraction withdrawn through line 27 so as to include the aromatic, hydroaromatic naphthenic constituents of this stream in the hydrogenation feed. Such a combination will be effected through line 47. This fraction may, however, be withdrawn separately as a product through line 26'.

In general, the solvent distillate fraction withdrawn through line 27 either separate from or in combination with the heavy naphtha fraction withdrawn through line 26 will contain 2, 3 and 4-ring aromatic compounds, 2, 3 and 4-ring hydroaromatics and 2, 3 and 4-ring naphthenic components and homologs of each of these compounds. Generally, the solvent or diluent distillate fraction will contain from about 45 to about 75 wt % aromatics, from about 15 to about 30 wt % hydroaromatics and from about 10 to about 25 wt % naphthenic constituents. In the embodiment illustrated, then, this stream will be catalytically hydrogenated in hydrogenation vessel 29 with molecular hydrogen introduced through line 30. The hydrogen actually used may be from any source, but in a preferred embodiment will be produced either through the steam reforming of at least a portion of the gaseous product from liquefaction or by gasification of at least a portion of the liquefaction bottoms. In the embodiment illustrated, unreacted hydrogen and the gaseous products of hydrogenation are withdrawn through line 31. When desired, this gaseous product may be treated to recover recycle hydrogen. Also in the embodiment illustrated, the hydrogenated product is withdrawn through line 32.

Preferably, the hydrogenation will be accomplished at a temperature within the range from about 650° to about 850° F. and at a pressure within the range from about 1250 to about 2000 psig. The hydrogen treat rate during the hydrogenation generally will be within the range from about 2000 to about 5000 scf/bbl and the hydrogenation vessel or vessels will be sized so as to provide a holding time within the range from about 30 to about 120 minutes. In general, any of the known hydrogenation catalysts may be employed. In general, the hydrogenation will be controlled such that the product withdrawn through line 32 will, generally, contain from about 10 to about 55 wt % aromatics, from about 30 to about 50 wt % hydroaromatics or hydrogen donor species and from about 15 to about 40 wt % naphthenic components. As illustrated in FIG. 2, the concentration of naphthenic components can be made to vary with hydrogenation severity and in accordance with the present invention the severity will, generally, be controlled such that the yield of naphthenic components is at least 20 wt %.

In the preferred embodiment, the total liquid hydrogenation effluent will be passed directly to a countercurrent extraction unit 33. In the countercurrent extraction unit, the hydrogenated product will be contacted with a solvent to extract the aromatic and hydroaromatic components from the naphthenic components. As previously indicated, any of the known suitable solvents may be used. In the embodiment illustrated, the solvent is introduced through line 34 and the selective solvent containing extracted aromatics and hydroaromatics is withdrawn through line 35. The extracted aromatic and hydroaromatic stream will, after separation from the selective solvent, generally, contain from about 15 to about 60 wt % aromatics and from about 40 to about 85 wt % hydroaromatics.

The extracted aromatic and hydroaromatic components which are withdrawn through line 35 are separated from the extraction solvent in separator 36. The particular means used to effect the separation will vary with the solvent but in the embodiment illustrated, the solvent is flashed overhead and recovered through line 37 and the aromatic and hydroaromatic materials withdrawn through line 38. All or a portion of the aromatic and hydroaromatic stream may then be recycled to mixing vessel 10 through lines 12' and 12. To the extent that excess solvent is available the excess may be withdrawn through line 46. To the extent that the amount of materials recycled is insufficient to provide the desired amount of solvent, makeup solvent may be added through line 14.

The naphthenic materials are withdrawn from extraction unit 33 through line 36'. Generally, this stream will contain from about 80 to about 90 wt % naphthenic components and is suitable for use directly as a jet fuel, a diesel fuel and/or an ASTM No. 2 fuel oil depending primarily on the boiling range of the fraction selected.

Having thus broadly described the present invention and a preferred embodiment thereof, it is believed that the same will become even more apparent by reference to the following examples. It will be appreciated, however, that the examples are presented for purposes of illustration and should not be construed as limiting the invention.

EXAMPLE 1

In this example, a run was completed in a 1 ton-per-day continuous unit at a pressure of 1500 psig and a temperature of 840° F. During this run, a Wyoming coal was liquefied and at steady state conditions, a 400°–800° F. distillate fraction was separated from the liquefaction product and hydrogenated at a temperature of 700° F., a total pressure of 1650 psig at a hydrogen treat rate of 3000 SCF/bbl. The holding time during hydrogenation was 60 minutes. The hydrogenated solvent was fractionated to obtain a distillate fraction having an initial boiling point of 350° F. and final boiling point of 525° F. This fraction was then extracted using sulfolane as an extraction solvent in a continuous extraction column (11 actual stages). During the extraction 8 volumes of solvent were used per volume of hydrogenated solvent distillate fraction. The aromatics and hydroaromatics were selectively extracted with the sulfolane solvent, separated and recycled as hydrogen donor solvent in the liquefaction operation. The remaining naphthenic fraction had an initial boiling point of 350° F., a final boiling point of 525° F. and contained 15 wt % aromatics. The inspections of this naphthenic fraction are summarized and compared with "Jet A" inspections below:

| Inspection | Naphthenic Raffinate Fraction | "Jet A" Specifications |
|---|---|---|
| Aromatics, vol. % | 15 | 20 max. |
| Smoke Point | 22 | 20 min. |
| Flash Point, °F. | 150 | 100 min. |
| Freeze Point, °F. | −48 | −41 max. |
| Viscosity, cst at −4° F. | 6 | 8 max. |
| Existent Gum, mg/100 ml | 3.2 | 7 max. |
| Distillation Temperature °F. | | |
| 10% Recovery | 392 | 400 max. |
| EP | 514 | 572 max. |
| Distillation Residue wt % | 1 | 1.5 max. |
| Distillation Loss, wt % | 1 | 1.5 max. |
| Net Heat of Combustion, BTU/LB | 19,000 | 18,400 min. |
| Gravity | 38 | 37 min. |

While the present invention has been described and illustrated by reference to particular embodiments thereof, it will be appreciated by those of ordinary skill in the art that the same lends itself to variations not necessarily illustrated herein. For this reason, then, reference should be made solely to the appended claims for purposes of determining the true scope of the present invention.

Having thus described and illustrated the invention, what is claimed is:

1. In a process for liquefying coal and similar solid carbonaceous materials wherein the solid carbonaceous material is slurried with a hydrogen donor solvent derived from the solid carbonaceous material subjected to liquefaction and wherein the liquefaction is accomplished at elevated temperatures and pressures and a portion of the liquefaction product said portion having an initial boiling point within the range from about 350° F. to about 450° F. and a final boiling point within the range from about 650° F. and to about 950° F. separated, subjected to hydrogenation and used as the hydrogen donor solvent, the improvement wherein the conditions of hydrogenation are controlled such that the yield of napthenic components is from about 5 to about 30 weight percent greater than the concentration of napthenic components in the unhydrogenated fraction and the napthenic components of the fraction subjected to hydrogenation and used as the hydrogen donor solvent are separated and used as a jet fuel, a diesel fuel or an ASTM No. 2 fuel oil or as components therein.

2. The improvement of claim 1 wherein the distillate fraction subjected to hydrogenation has an initial boiling point of about 350° F., a final boiling point within the range from about 750° F. to about 850° F., the distillate fraction is further fractionated to obtain a fraction having an initial boiling point of about 350° F. and a final boiling point of about 550° F. and at least a portion of the naphthenic components contained in this fraction are then separated and used as or in a jet fuel.

3. The improvement of claim 1 wherein the distillate fraction subjected to hydrogenation has an initial boiling point of about 350° F., a final boiling point within the range from about 750° F. to about 850° F., the distillate fraction is further fractionated to obtain a fraction having an initial boiling point of about 350° F. and a final boiling point of about 600° F. and at least a portion of the naphthenic components contained in this fraction are then separated and used as or in a diesel fuel.

4. The improvement of claim 1 wherein the distillate fraction subjected to hydrogenation has an initial boiling point of about 350° F., a final boiling point within the range from about 750° F. to about 850° F., the distillate fraction is further fractionated to obtain a fraction having an initial boiling point of about 350° F. and a final boiling point within the range from about 650° F. to about 700° F. and at least a portion of the naphthenic components contained in this fraction are then separated and used as or in an ASTM No. 2 fuel oil.

* * * * *